US006308419B1

(12) United States Patent
Neshat et al.

(10) Patent No.: US 6,308,419 B1
(45) Date of Patent: Oct. 30, 2001

(54) SLEEVE FOR THE BLADE OF A KNIFE

(75) Inventors: Michael Neshat; Dustin Smith, both of Walnut Ridge, AR (US)

(73) Assignee: The Pampered Chef, Ltd., Addison, IL (US)

( * ) Notice: Subject to any disclaimer, the term of this patent is extended or adjusted under 35 U.S.C. 154(b) by 0 days.

(21) Appl. No.: 09/387,002

(22) Filed: Aug. 31, 1999

(51) Int. Cl.[7] ..... B26B 29/00
(52) U.S. Cl. ..... 30/151; 30/286
(58) Field of Search ..... 30/151, 286, 162, 30/30, 504; 224/232

(56) References Cited

U.S. PATENT DOCUMENTS

| | | | |
|---|---|---|---|
| 660,302 | 10/1900 | Lowman . | |
| 831,770 | 9/1906 | Bragg . | |
| 1,276,554 | 8/1918 | Maxim . | |
| 1,876,284 | 9/1932 | Fried . | |
| 1,888,289 | 11/1932 | Raffles . | |
| 3,191,825 | 6/1965 | Beckwith | 224/2 |
| 3,381,807 | 5/1968 | De Vaughn | 206/16 |
| 5,581,890 * | 12/1996 | Schmidt | 30/162 |

* cited by examiner

*Primary Examiner*—Douglas D Watts
(74) *Attorney, Agent, or Firm*—Olson & Hierl, Ltd.

(57) ABSTRACT

A sleeve which is slid over the blade of a knife or the like and includes two interconnected sections. One of the sections includes a plurality of spaced molded clips formed in and spaced along a shoulder which extends around the periphery of the one section. The other section includes a plurality of cut-outs formed in and spaced along a shoulder which extends around the periphery of the other section. The clips on the one section extend through the openings defined by the cut-outs in the other section respectively and latch onto the shoulder on the other section for coupling the first and second sections together to form the sleeve.

13 Claims, 3 Drawing Sheets

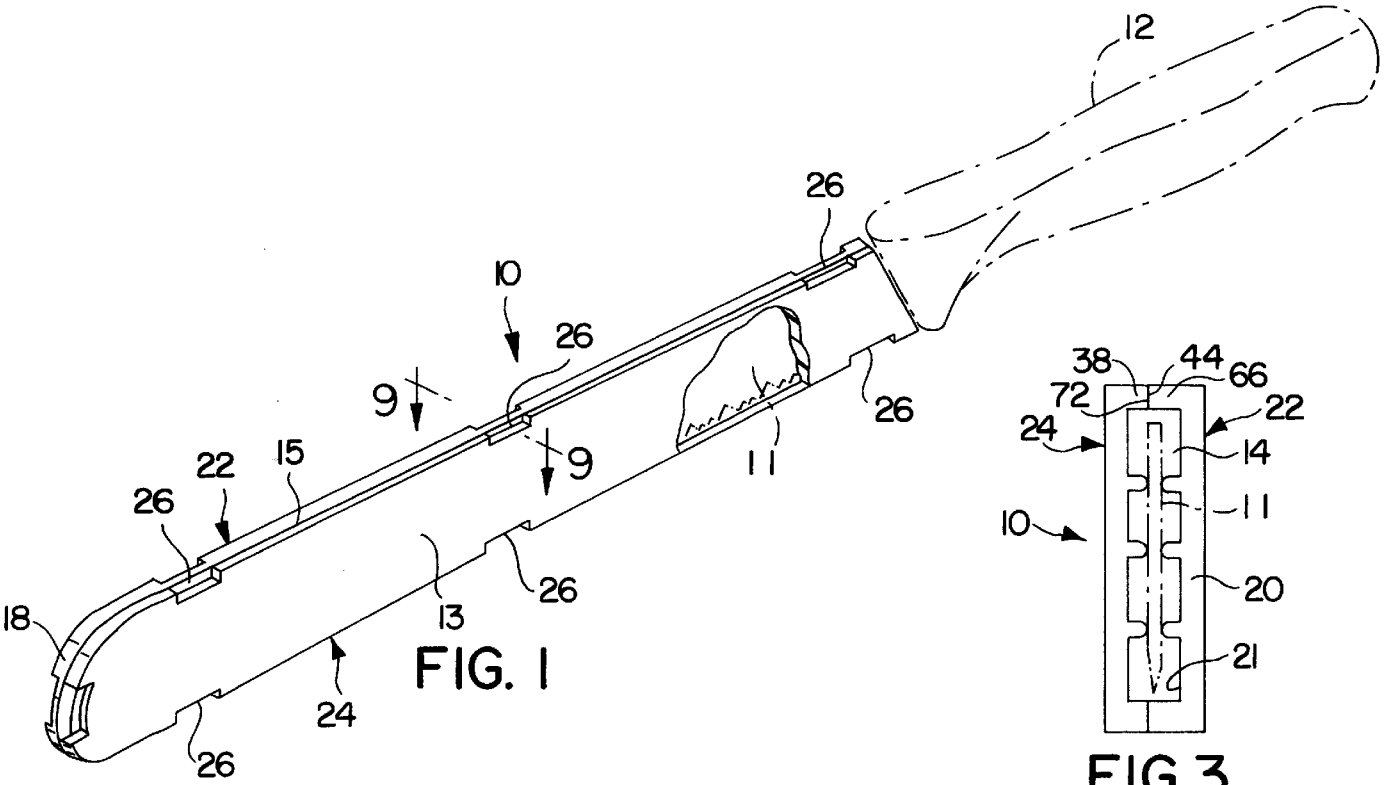
FIG. 1
FIG. 3
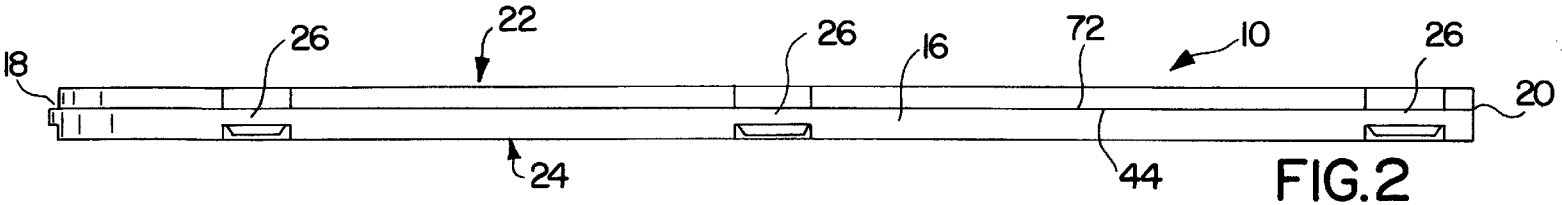
FIG. 2

SLEEVE FOR THE BLADE OF A KNIFE

TECHNICAL FIELD OF THE INVENTION

This invention relates to a protective sleeve for the blade of a knife or a similar implement.

BACKGROUND OF THE INVENTION

Various types of sleeves have been used to cover the blades of implements such as knives or the like including sleeves which have included cooperating, interconnected sections. Although these sleeves have been satisfactory, there remains a need for a sleeve in which the cooperating sections can be easily and quickly interconnected and assembled at either the point of manufacture or the point of purchase.

SUMMARY OF THE INVENTION

The subject invention relates to a new and useful sleeve including respective halves incorporating coupling elements which allow the sleeve to be easily and quickly assembled either at the point of manufacture or at the point of purchase.

In accordance with the present invention, the sleeve includes first and second coupled half sections each including top and bottom peripheral edges and a unitary distal peripheral edge which together define a sleeve with top and bottom peripheral surfaces, a distal peripheral surface defining a closed end, and an opposed open proximal end through which the blade of the knife is received.

The first and second sections respectively include a plurality of clips and associated cut-outs extending along the respective top, bottom and distal peripheral edges in spaced-apart relationship for coupling and snapping the first and second sections together.

In one embodiment, each of the first and second sections includes a shoulder which extends along the top, bottom and peripheral edges thereof. Each of the shoulders includes inner and outer surfaces and the clips on the first section are formed in and extend outwardly from the shoulder thereon. The cut-outs in the second section are formed in and extend parallel to the shoulder thereon.

Moreover, in this embodiment, the clips extend generally perpendicularly outwardly between the inner and outer surfaces of the shoulder thereon and define a plurality of recesses in the shoulder. The cut-outs in the second section define a plurality of latch bars which extend in spaced-apart relationship along the shoulder thereon.

The clips further include a latch or finger whereby, when the first and second sections are coupled together, the clips extend through the respective openings formed by the cut-outs and the finger on the clips wraps around the respective latch bars formed in the shoulder on the second section.

Various other objects, aims, purposes, features, advantages, embodiments, variations, and the like will be apparent to those skilled in the art from the teachings of the present specification taken with the associated drawings and the appended claims.

BRIEF DESCRIPTION OF THE DRAWINGS

In the Drawings,

FIG. 1 is a perspective view of a sleeve according to the present invention shown covering the blade of a knife;

FIG. 2 is a bottom plan view of the sleeve of FIG. 1;

FIG. 3 is an elevational view of the open end of the sleeve shown in FIG. 1;

DESCRIPTION OF THE PREFERRED EMBODIMENT

Figures 4, 5:
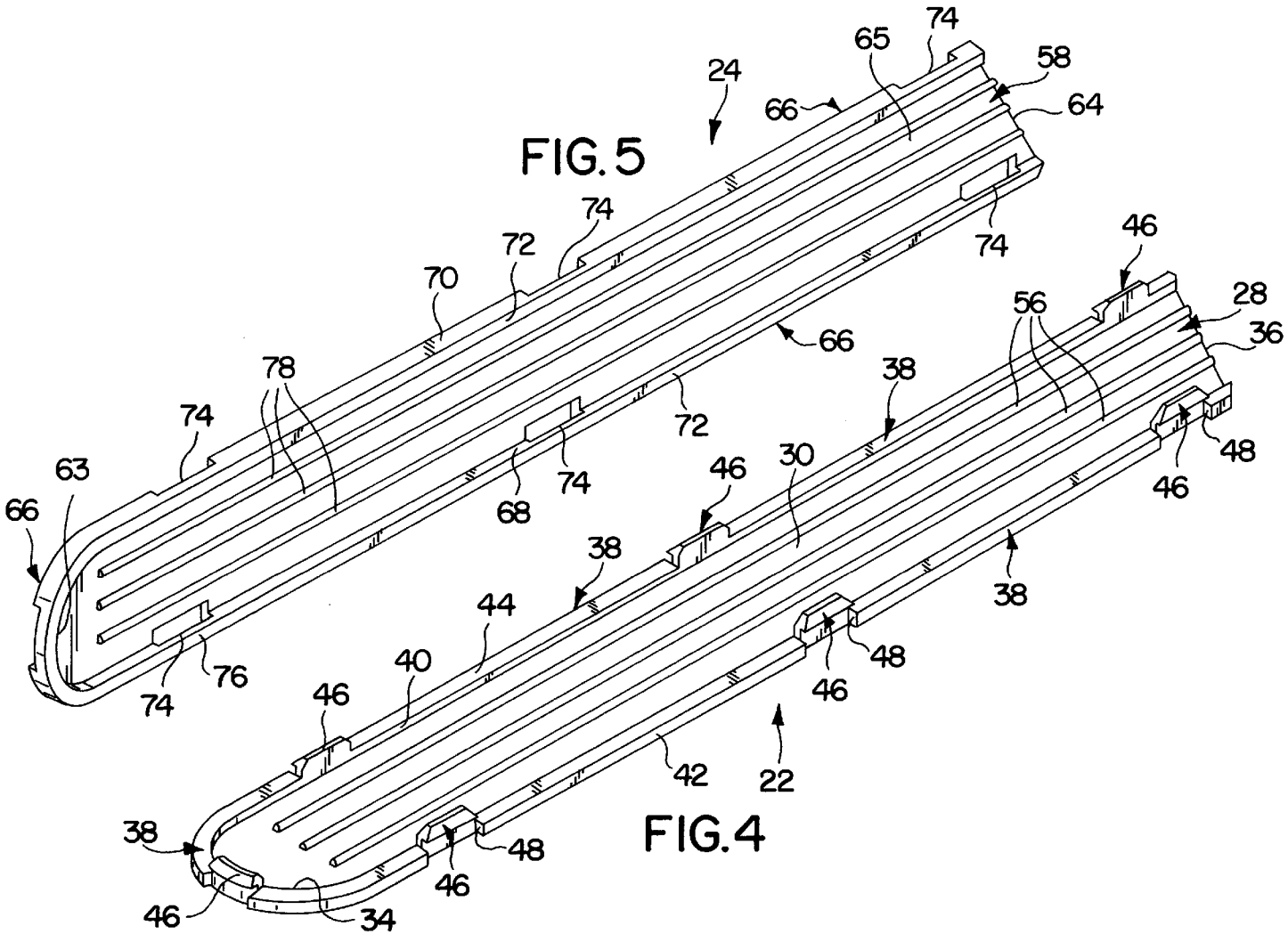
FIG. 4 is a perspective view of the half section of the sleeve of FIG. 1 including clips.
FIG. 5 is a perspective view of the other of the half sections of the sleeve of FIG. 1 including cut-outs therein.

While this invention is susceptible to embodiments in many different forms, this specification and the accompanying drawings disclose only one of the preferred forms as examples of the invention wherein the sleeve is used to cover the blade of a bread knife or the like. This invention, however, is not intended to be limited to the embodiment so described and the scope thereof is identified in the appended claims.

An elongate protective sleeve 10 constructed in accordance with the present invention is shown in FIG. 1 covering the blade 11 of a knife 12.

The sleeve 10 includes an elongate body 13 defining a cavity 14 (FIG. 3) adapted to receive the blade 11 of the knife 12. The sleeve body 13 includes a generally flat longitudinally extending top peripheral surface 15, a generally flat longitudinally extending bottom peripheral surface 16 (FIG. 2) which is opposed and parallel to the top peripheral surface 15, a curved distal peripheral surface 18 extending unitarily between the distal peripheral edges of the top and bottom surfaces 15 and 16 respectively, and an opposed open proximal end 20 (FIG. 3) which defines the cavity 14 and an opening 21 through which the knife blade 11 is received.

As shown in FIGS. 4 and 5, the sleeve 10 comprises first and second cooperating and interconnected molded parts or half sections 22 and 24, respectively, which are similarly shaped and may be made from any suitable material such as, for example, plastic or the like material.

The first and second parts 22 and 24 are held and secured together by unitary coupling elements 26 (FIGS. 1 and 2) which extend around the peripheral top, bottom and distal surfaces 15, 16 and 18, respectively, in spaced-apart relationship. In the embodiment shown, each of the coupling elements 26 comprises a cooperating clip and cut-out structure associated with the first and second parts 22 and 24, respectively, as explained in more detail below.

Figure 6:
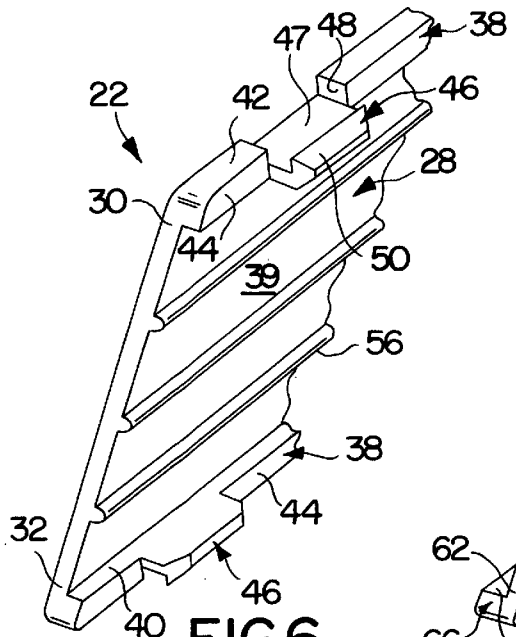
FIG. 6 is an enlarged, broken perspective view of a portion of the proximal end of the sleeve half section shown in FIG. 4.

Referring to FIGS. 4 and 6, the first part 22 includes an elongate generally flat face 28 having a length and a width corresponding generally to the length and the width of the knife blade 11. The face 28 includes a top peripheral longitudinally extending edge 30, a bottom peripheral longitudinally extending edge 32 opposed and generally parallel to the top edge 30, a curved distal peripheral edge 34 unitary with, and extending between, the distal ends of the top and bottom peripheral edges 30 and 32, respectively, and a proximal peripheral edge 36 extending unitarily and angularly between the proximal ends of the top and bottom peripheral edges 30 and 32. In the embodiment shown, the edge 36 is inclined at an angle corresponding to the angle at which the proximal end of the handle of the knife 12 is inclined.

A unitary molded shoulder 38 projects generally perpendicularly outwardly from the inner surface 39 of the face 28 and extends around the top, bottom and distal peripheral edges 30, 32 and 34 thereof.

As shown in FIG. 6, the shoulder 38 includes inner and outer spaced-apart and generally parallel faces 40 and 42, respectively, and a generally perpendicular end face 44 therebetween which is positioned in a generally spaced-apart and parallel relationship to the inner surface 39 of the face 28. A plurality of unitary molded clips or tabs 46 project generally perpendicularly outwardly from the inner surface 39 of the face 28 and extend in a spaced-apart relationship around the respective top, bottom and distal peripheral edges 30, 32 and 34 thereof.

Each of the clips 46 is positioned relative to the shoulder 38 in a relationship wherein the outer surface 47 of each of the clips 46 is positioned between, and generally parallel to, the inner and outer faces 40 and 42, respectively, of the shoulder 38 so as to define a plurality of recesses 48 in the shoulder 38 which extend in a spaced-apart relationship along the respective top, bottom and distal peripheral edges 30, 32 and 34 of the face 28.

As shown in FIG. 6, each of the clips 46 includes a distal unitary latch or finger 50 which extends generally perpendicularly outwardly from the outer surface 47 of the clip 46 adjacent the distal end thereof. The finger 50 extends in the direction of the outer face 42 of the shoulder 38 and in a spaced-apart and parallel relationship to the end face 44 of the shoulder 38.

Figure 8:
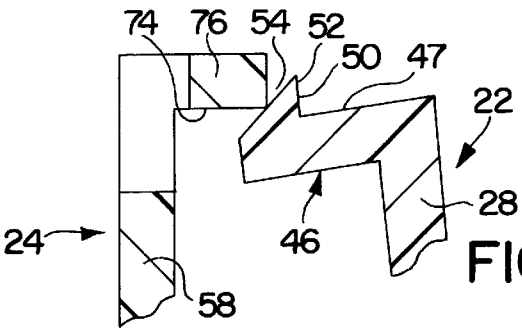
FIG. 8 is an enlarged, broken, vertical cross-sectional view depicting a clip on the one of the sleeve half sections in its deflected condition upon insertion thereof into the opening defined by the cut-out in the other of the sleeve half sections.

As shown in FIG. 8, the finger 50 is generally triangularly shaped in vertical cross-section and includes a vertically oriented outer face 52 positioned in a spaced-apart and parallel relationship to the end face 44 of the shoulder 38 and a unitary inclined guide or cam face 54 which forms the hypotenuse side of the triangularly shaped finger 50.

The clip 46 which is positioned along the curved distal peripheral edge 34 of the part 22 differs in structure from the other clips 46 in that it includes a curvature corresponding generally to the curvature of the peripheral edge 34.

Referring back to FIG. 4, the first part 22 additionally includes a plurality of spaced-apart ribs 56 projecting outwardly from, and extending longitudinally along, the inner surface of the face 28 thereof.

Figure 7:
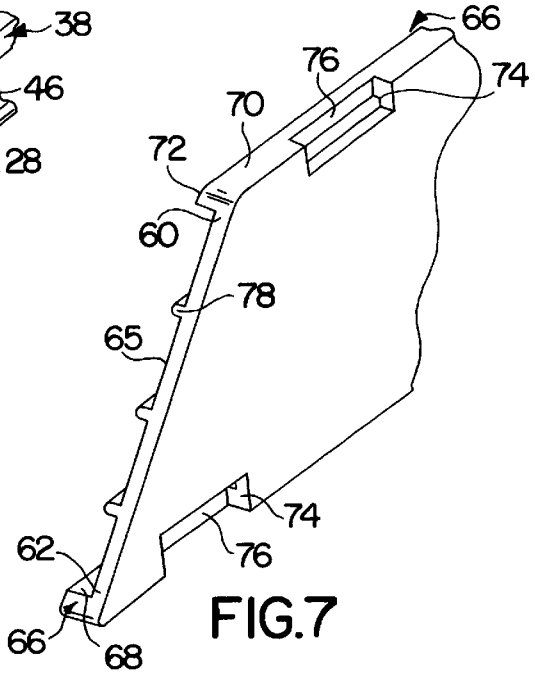
FIG. 7 is an enlarged, broken perspective view of a portion of the proximal end of the sleeve half section shown in FIG. 5.

Referring now to FIGS. 5 and 7, the second part 24 includes an elongate generally flat face 58 having a length and a width corresponding generally to the length and the width of the first part 22. As with the first part 22, the second part 24 includes a top peripheral longitudinally extending edge 60, a bottom peripheral longitudinally extending edge 62 opposed and parallel to the top edge 60, a curved distal peripheral edge 63 unitary with, and extending between, the distal ends of the top and bottom peripheral edges 60 and 62, and a proximal peripheral edge 64 unitary with, and extending angularly between, the proximal ends of the top and bottom peripheral edges 60 and 62. The edge 64 is inclined at the same angle as the proximal edge 36 of the first part 22.

Like the first part 22, the second part 24 also includes a unitary shoulder 66 which projects generally perpendicularly outwardly from the inner surface 65 of the face 58 and extends around the top, bottom and distal peripheral edges 60, 62 and 64 thereof. The shoulder 66 includes inner and outer spaced-apart and generally parallel faces 68 and 70 respectively and a generally perpendicular end face 72 therebetween which is positioned in a generally spaced-apart and parallel relationship to the inner surface 65 of the face 58.

The second part 24 differs in structure from the first part 22 in that the thickness of the shoulder 66 on the second part 22 is greater than the thickness of the shoulder 38 on the part 22. Additionally, the second part 24 includes a plurality of generally rectangularly shaped cut-outs 74 which define a plurality of generally rectangularly shaped clip receiving openings. The cut-outs 74 are formed in the face 58 and the shoulder 66 and extend in a spaced-apart relationship around the respective top, bottom and distal peripheral edges 60, 62 and 64 thereof.

As shown in FIG. 7, the cut-outs 74 are oriented in a position generally parallel to the shoulder 66 and extend laterally from the outer face 70 of the shoulder 66 in the direction of the ribs 78 which are formed in the face 58. In the embodiment shown, each of the cut-outs 74 has a length corresponding generally to the width of the clips 46 in the first part 22, a width generally about twice the width of the shoulder 66, and a thickness generally about one-third the thickness of the shoulder 66. This particular orientation and structure of the cut-outs 74 in the second part 24 define a plurality of spaced-apart clip latch bars 76 in the shoulder 66 of the part 24.

The cut-out 74 positioned in the portion of the shoulder 66 extending along the curved distal peripheral edge 64 of the part 24 differs in structure from the other cut-out 74 in that the opening therein includes a curvature corresponding generally to the curvature of the peripheral edge 64.

As shown in FIG. 5, the ribs 78 project outwardly from, and extend longitudinally along, the inner surface of the face 58 of the part 24.

The molded clip and cooperating cut-out structure described in detail above allows for the easy and quick assembly of the first and second parts 22 and 24 either during manufacture or at the point of purchase as described below. The structure also allows the parts 22 and 24 to be separated and cleaned by a user.

Referring to FIGS. 4–7, the assembly of the sleeve 10 initially requires the alignment of the respective parts 22 and 24 in an opposed and generally parallel relationship with the clips 46 on the first part 22 in a generally horizontal and vertical co-planar alignment with the cut-outs 74 in the second part 24.

Figure 9:
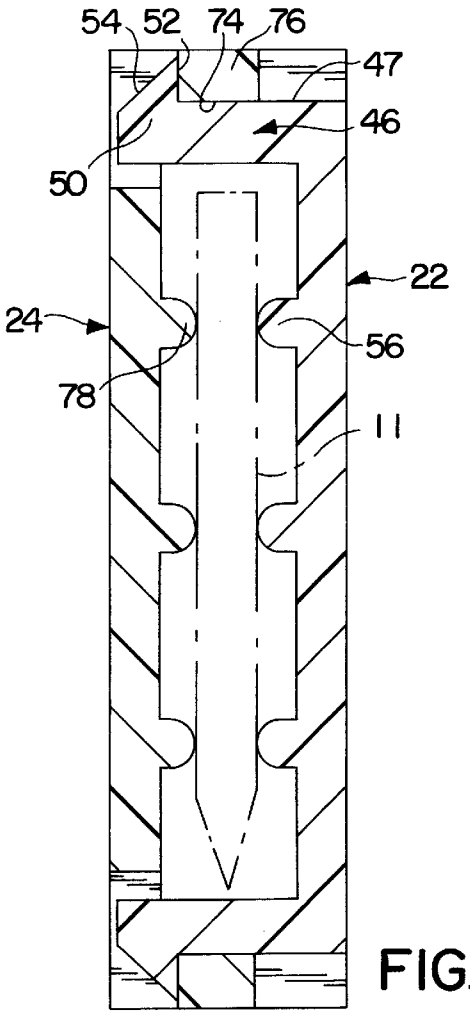
FIG. 9 is an enlarged, vertical cross-sectional view of the sleeve taken along the lines 9—9 in FIG. 1.

The two parts 22 and 24 are then subsequently brought and snapped together as shown in FIGS. 8 and 9. As shown in FIG. 8, the inclined end face 54 of the finger 50 on each of the clips 46 facilitates the coupling of the clips 46 within the respective cut-outs 74 by guiding and flexing the clips 46 away from the respective latch bars 76 in the shoulder 66 of the part 24 as the two parts 22 and 24 are drawn together into an abutting relationship.

The continued advancement of the clips 46 relative to the part 24 through the respective openings defined by the cut-outs 74 then allows the clips 46 to clear the respective latch bars 76 and snap back into the coupling and latched relationship as shown in FIG. 9 wherein the outer face 52 of the finger 50 is in an abutting relationship with the outer face of the latch bars 76 and the outer face 47 of the clips 46 is in abutting relationship with the inner face of the latch bars 76. In this coupled and snapped relationship, the end faces 44 and 72 of the respective shoulders 38 and 66 of the first and second parts 22 and 24 abut each other as shown in FIGS. 2 and 3 and define the top, bottom and distal peripheral surfaces 15, 16 and 18 of the sleeve 10.

As also shown in FIG. 9, the knife blade 11 is slid into and through the space defined between the ribs 56 and 78 in the parts 22 and 24, respectively. The respective side faces of the blade 11 abut the ends of the ribs 50 and 78 to keep the blade 11 firmly secured within the sleeve 10.

It will be readily apparent from the foregoing detailed description of the invention and from the illustrations thereof that numerous variations and modifications may be effected without departing from the true spirit and scope of the novel concepts or principles of this invention. For example, although the disclosed sleeve embodiment is configured and adapted to cover the blade of a bread knife or the like, it is readily apparent that the sleeve may be adapted and configured to cover other types of bladed implements.

What is claimed is:

1. A sleeve for the blade of a knife, the sleeve comprising first and second coupled sections together defining top and bottom peripheral surfaces, a distal peripheral surface defining a closed end, and an opposed open proximal end through which the blade of the knife is received, said first and second sections respectively including a plurality of clips and associated clip receiving cut-outs defining openings extending along the top, bottom and distal peripheral surfaces in spaced-apart relationship for coupling said first and second sections together, said cut-outs in said second section being positioned substantially parallel to said top, bottom and distal peripheral surfaces.

2. The sleeve of claim 1 wherein each of said first and second sections includes top and bottom shouldered peripheral edges and a unitary curved distal shouldered peripheral edge, said shouldered peripheral edges of said first and second sections defining said respective peripheral surfaces of said sleeve when said first and second sections are coupled together.

3. The sleeve of claim 2 wherein said clips extend unitarily outwardly from and are spaced along said shouldered peripheral edges of said first section.

4. A sleeve for the blade of a knife, the sleeve comprising first and second coupled sections together defining top and bottom peripheral surfaces, a distal peripheral surface defining a closed end, and an opposed open proximal end through which the blade of the knife is received, said first and second sections including a plurality of clips and associated clip receiving cut-outs defining openings extending along the top, bottom and distal peripheral surfaces in spaced-apart relationship for coupling said first and second sections together, each of said first and second sections including top and bottom shouldered peripheral edges and a unitary curved distal shouldered peripheral edge, said shouldered peripheral edges of said first and second sections defining said respective peripheral surfaces of said sleeve when said first and second sections are coupled together, said shouldered peripheral edges of said first section including an inner surface and an outer surface, said clips extending generally perpendicularly outwardly from said shouldered peripheral edges between said inner and outer surfaces and defining a plurality of recesses in said shouldered peripheral edges of said first section.

5. A sleeve for the blade of a knife, the sleeve comprising first and second coupled sections together defining top and bottom peripheral surfaces, a distal peripheral surface defining a closed end, and an opposed open proximal end through which the blade of the knife is received, said first and second sections including a plurality of clips and associated clip receiving cut-outs defining openings extending along the top, bottom and distal peripheral surfaces in spaced-apart relationship for coupling said first and second sections together, each of said first and second sections including top and bottom shouldered peripheral edges and a unitary curved distal shouldered peripheral edge, said shouldered peripheral edges of said first and second sections defining said respective peripheral surfaces of said sleeve when said first and second sections are coupled together, said cut-outs in said second section being positioned parallel to and spaced along said shouldered peripheral edges of said second section, said cut-outs being formed in said shouldered peripheral edges and defining a plurality of latch bars extending along said shouldered peripheral edges of said second section in spaced-apart relationship.

6. A sleeve for the blade of a knife, the sleeve comprising first and second coupled sections together defining top and bottom peripheral surfaces, a distal peripheral surface defining a closed end, and an opposed open proximal end through which the blade of the knife is received, said first and second sections including a plurality of clips and associated clip receiving cut-outs defining openings extending along the top, bottom and distal peripheral surfaces in spaced-apart relationship for coupling said first and second sections together, each of said first and second sections including top and bottom shouldered peripheral edges and a unitary curved distal shouldered peripheral edge, said shouldered peripheral edges of said first and second sections defining said respective peripheral surfaces of said sleeve when said first and second sections are coupled together, said cut-outs in said second section being positioned parallel to and spaced along said shouldered peripheral edges of said second section, said cut-outs being formed in said shouldered peripheral edges and defining a plurality of latch bars extending along said shouldered peripheral edges of said second section in spaced-apart relationship, said clips extending unitarily outwardly from and spaced along said shouldered peripheral edges of said first section and said cut-outs being positioned parallel to and spaced along said shouldered peripheral edges of said second section, each of said clips further including a finger whereby, when said first and second sections are coupled together, said clips extend through said respective openings defined by said cut-outs and said fingers on said clips wrap around said respective latch bars in said shoulder of said second section.

7. A sleeve adapted to be slid over the blade of an implement, the sleeve comprising first and second sections including respective peripheral shoulders, a plurality of clips molded into and extending outwardly from said shoulder on said first section in spaced-apart relationship and a plurality of cut-outs in and extending parallel to said shoulder on said second section in spaced-apart relationship, the plurality of clips and cut-outs respectively extending around the peripheral shoulders thereof in spaced-apart relationship, said clips including a unitary finger spaced from and generally parallel to said shoulder on said first section whereby, when said first and second sections are coupled together to form said sleeve, said clips on said first section extend through said cut-outs in said second section and said finger on said clips wrap around and abut against said shoulder on said second section.

8. The sleeve of claim 7 wherein said shoulder on each of said first and second sections includes an end face, said end faces of said respective shoulders abutting each other when said first and second sections are coupled together to form said sleeve.

9. The sleeve of claim 7 wherein each of said first and second sections includes a curved distal peripheral edge defining a closed distal end when said first and second sections are coupled together, said clip and said cut-out on said first and second sections respectively being curved and located along said curved distal peripheral edge of said first and second sections respectively.

10. The sleeve of claim 7 wherein each of said first and second sections includes a plurality of spaced-apart longitudinally extending and outwardly projecting ribs.

11. The sleeve of claim 7 wherein each of said first and second sections is composed of a molded plastic material.

12. A sleeve adapted to be slid over the blade of an implement, the sleeve comprising first and second sections including respective peripheral shoulders, a clip molded into and extending outwardly from said shoulder on said first section and a cut-out in and extending parallel to said shoulder on said second section, said clip including a unitary finger spaced from and generally parallel to said shoulder on said first section whereby, when said first and second sections are coupled together to form said sleeve, said clip on said first section extends through said cut-out in said second section and said finger on said clip wraps around and abuts against said shoulder on said second section, said shoulder on each of said first and second sections including an inner surface and an outer surface, said clips extending generally perpendicularly outwardly from said shoulder on said first section between said inner and outer surfaces thereof and defining a plurality of recesses in said shoulder on said first section.

13. A sleeve adapted to be slid over the blade of an implement, the sleeve comprising first and second sections including respective peripheral shoulders, a plurality of clips molded into and extending outwardly from said shoulder on said first section in spaced-apart relationship and a plurality of cut-outs in and extending parallel to said shoulder on said second section in spaced-apart relationship, said clips including a unitary finger spaced from and generally parallel to said shoulder on said first section whereby, when said first and second sections are coupled together to form said sleeve, said clips on said first section extend through said cut-outs in said second section respectively and said finger on said clips wraps around and abuts against said shoulder on said second section, said cut-outs in said shoulder on said second section defining a plurality of spaced-apart latch bars in said shoulder adapted to engage with the respective clips formed in said shoulder on said first section.

* * * * *